US006026760A

United States Patent [19]

Phillips et al.

[11] Patent Number: 6,026,760

[45] Date of Patent: Feb. 22, 2000

[54] FLOATATION DEVICE

[75] Inventors: Jerry S. Phillips, Marietta, Ga.; David W. Brown, Oak Ridge, Tenn.; Wayne Bean, Marietta, Ga.; Donald H. Sigler, Jr., Kalispell, Mont.

[73] Assignee: Innovative Coatings Corporation, Kennesaw, Ga.

[21] Appl. No.: 09/004,900

[22] Filed: Jan. 9, 1998

[51] Int. Cl.[7] ..... B63B 35/44

[52] U.S. Cl. ..... 114/267; 114/357

[58] Field of Search ..... 114/222, 227, 114/267, 315, 357; 441/106

[56] References Cited

U.S. PATENT DOCUMENTS

| | | | |
|---|---|---|---|
| 3,929,549 | 12/1975 | Smith | 114/357 |
| 4,519,856 | 5/1985 | Lazzara | 114/227 |
| 5,017,322 | 5/1991 | Brooks | 114/357 |
| 5,081,946 | 1/1992 | Nannig et al. | 114/267 |
| 5,133,276 | 7/1992 | Alesi, Jr. et al. | 114/267 |
| 5,192,603 | 3/1993 | Slater et al. | 114/222 |
| 5,660,572 | 8/1997 | Buck | 441/106 |

*Primary Examiner*—Stephen Avila
*Attorney, Agent, or Firm*—Jones & Askew, LLP

[57] ABSTRACT

The present invention is a floatation device comprising a foam material coated with an elastomeric material, desirably a polyurea. The floatation device is particularly useful as a support for docks, boathouses, and the like.

19 Claims, No Drawings

FLOATATION DEVICE

TECHNICAL FIELD

The present invention is in the field of floatation devices for supporting docks, boathouses and the like on the water. More specifically, the present invention relates to coating a foam polymer such as polystyrene so that it can be used as a floatation device.

BACKGROUND OF THE INVENTION

One of the most popular supports for docks, boathouses and other structures on water are solid blocks of foam plastic. These floatation units have been attached to wooden decks and boathouses by various methods such as plastic straps, metal straps and various fasteners. These blocks of foam plastic are constantly in contact with water and eventually deteriorate and become waterlogged. When this happens, the foam plastic must be replaced with new blocks of foam plastic. Disposal of the old foam plastic blocks has become a serious problem. Often, the old foam plastic blocks are simply released onto the body of water. Because the blocks are made of polymers, they do not break down in the environment. The free floating blocks are an eyesore and can be a danger to boats.

What is needed is a floatation system that will withstand contact with water, will not deteriorate when exposed to the weather, and be durable enough to withstand normal impact abuse associated with floatation devices. In addition, the floatation system should be capable of recycling used foam plastic blocks.

SUMMARY OF THE INVENTION

The present invention addresses the foregoing problems in floatation systems by providing a system that is completely waterproof and is highly durable. The present invention is a floatation device that is comprised of a foam interior that is coated with a fast-curing elastomeric material using spray techniques whereby a homogeneous, non-porous, and monolithic coating is formed. The floatation system can be easily attached to a dock or boathouse and will remain intact for long periods of time. The present invention also includes a method for manufacturing a floatation device comprising spraying or otherwise administering an elastomeric material, preferably a polyurea, to a foam material thereby producing a floatation device that is useful for supporting docks, boathouses and the like on water. The present invention also includes a method of manufacturing the floatation device comprising applying an elastomeric material to the surface of a foam such as expanded polystyrene.

Accordingly it is an object of the present invention to provide a floatation device that is waterproof, resistant to impact, and will remain functional for a long period of time.

It is another object of the present invention to provide a system that can produce floatation devices from used foams such as expanded polystyrene.

It is another object of the present invention to provide a floatation device that is resistant to degradation by sunlight.

It is yet another object of the present invention to provide a floatation device that will not sink or become waterlogged.

It is yet another object of the present invention to provide a floatation device that will not crack or peel over time.

These and other features and advantages of the present invention will become apparent after a review of the following detailed description of the disclosed embodiments.

DETAILED DESCRIPTION

The present invention is a floatation device that is comprised of a foam interior that is coated with a fast-curing elastomeric material using spray techniques whereby a homogeneous, non-porous, and monolithic coating is formed. The desired elastomeric materials used in the present invention are prepared by initiating the reaction of an isocyanate-terminated compound or polymer with an aliphatic or aromatic amine-terminated compound or polymer immediately before applying the elastomeric material to the surface to be coated. Desirably, the reactive components (i.e., isocyanate-containing and amine-containing materials) are mixed directly in a spray gun used to apply the elastomeric material. The thickness of the elastomeric coating can easily be controlled by conventional application means. It is important that the thickness of the elastomeric coating be enough so that the coating is resistant to impact that is normal in use. The desired thickness of the elastomeric coating on the foam material is between approximately 1 mil and 250 mils, with the most desired thickness of between 60 mils and 75 mils. The present invention also includes a method of manufacturing a floatation device comprising spraying a foam material with an elastomeric material on the foam so that the resulting device is substantially impermeable to water and is resistant to impact.

Foam materials that can be used in the present invention include, but are not limited to, expanded polystyrene, polyurethane and blown polyethylene foams. The floatation device of the present invention can also have wood or other material attached to the foam material before or after the elastomeric material is applied so that the foam material can be attached directly to the structure it is supporting.

The elastomeric material that is applied to the base substrate or floatation material includes, but is not limited to, polyurea, polyurethane, polyaspartics, epoxy, polyurethane-polyurea hybrids or other similar polymer. The desired polymer is polyurea. Polyureas are typically supplied in monomer form as two solutions. One solution is an isocyanate and the second solution is a polyamine. The resulting polymer after mixing the two components is a polyurea. The general reaction is shown as follows:

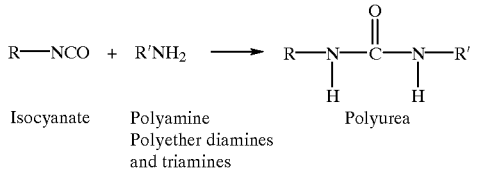

Another desired polymer is polyurethane which is supplied as two components, an isocyanate and a polyether polyol. The two solutions are mixed immediately before application to the base substrate or floatation material as shown in Examples 1, 2 and 3 herein. The polyurethane system requires the use of a catalyst such as an organotin, i.e., Dibutyl tin dilaurate. The general reaction for the production of a polyurethane polymer is as follows:

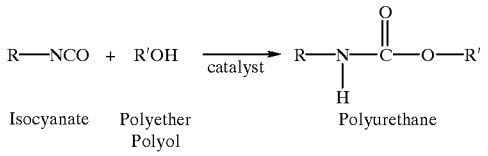

For the application of polyurea to a foam object, a polyether polyamine is mixed with the isocyanate immediately before the application of the mixture. The mixing of the two components is typically done in a spray gun and the mixture is sprayed onto the base substrate or floatation material. Polyurea is the desired coating because the formation of the polymer does not require a catalyst and the reaction is relatively temperature insensitive as well as relatively insensitive to water. Also, since polyurea has no volatile organic compounds (VOC's) the utilization of polyurea does not cause any EPA problems for the applicator or detriment to the foam blocks.

Polyamines that can be used in practicing the present invention include, but are not limited to, Jeffamine® D2000 and Jeffamine® T5000 (Huntsman Corp., Houston, Tex.) which are amine-terminated polypropylene glycols which have the following general structure;

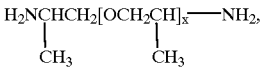

Ethacure® (Albemarle Corporation, Baton Rouge, La.) which is diethyltoluenediamine, and Unlink 4200 (UOP, Des Plaines, Ill.) which has the following formula:

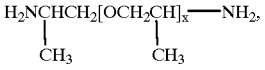

The desired urethane is diphenylmethame diisocyanate (ICI, West Deptford, N.J.).

The polyamines can be mixed together to form the desired physical properties. For floatation devices, the resulting polyurea should be rigid and exhibit a high tensile strength.

In practicing the present invention, the urethane and the polyamines solution (Solution A and Solution B respectively) are mixed immediately before application to the foam material. The mixing is done in the mixing portion of the application gun under pressure and the resulting mixture is applied uniformly to the base substrate of floatation material as shown is Examples 1, 2 and 3. The mixture that is applied to the base substrate or floatation material cures rapidly and results in a uniforn coating. The thickness of the coating acording to the present invention will vary depending upon the final physical qualities desired. The thickness of the coating os between approximately 1 mil and 250 mils, with a desired thickness of between 60 and 75 mils, and the most desired thickness of approximately 62.5 mils, which is approximately 1/16 of an inch.

The elastomeric coating can optionally have additives that will provide resistance to ultraviolet radiation of can have colorants added to provide a desired color.

This invention is further illustrated by the following examples, which are not to be construed in any way as imposing limitations upon the scope thereof. On the contrary, it is to be clearly understood that resort may be had to various other embodiments, modifications, and equivalents thereto which, after reading the description herein, may suggest themselves to those skilled in the art without departing from the spirit of the present invention.

EXAMPLE 1

An expanded polystyrene block was formed by conventional means. The block was then sprayed with a polyurea formulation having the following formula:

| | |
|---|---|
| Solution A | |
| Rubinate 9432 | 100% |
| Solution B | |
| Unilink 4200 | 5.0% |
| Jeffamine D2000 | 64.0% |
| Ethacure 100 | 23.0% |
| Jeffamine T5000 | 8.0% |

The components of Solution B were mixed together 1:1 by volume and the polymer solution (Solution A and Solution B) was applied using a plural component spray machine to a thickness of approximately 62.5 mils.

EXAMPLE 2

An expanded polystyrene block with the dimensions of 1 meter by 1 meter by 1 meter was sprayed with a polyurea formulation having the following formula:

| | |
|---|---|
| Solution A | |
| Rubinate 9432 | 100% |
| Solution B | |
| Unilink 4200 | 3.0% |
| Jeffamine D2000 | 65.875% |
| Ethacure 100 | 23.125% |
| Jeffamine T5000 | 8.0% |

The components of Solution B were mixed together 1:1 by volume and the polymer solution (Solution A and Solution B) was applied using a plural component spray machine to a thickness of approximately 62.5 mils.

EXAMPLE 3

The following example describes a method of using recycled polystyrene in the present invention. An expanded polystyrene block that had been used as a floatation device and had become unusable because it became waterlogged is dried. The unusable block of polystyrene is run through a foam-chopper or foam-shredder to cut the block into smaller pieces. The smaller pieces yield much greater surface area for moisture evaporation. The drying of the polystyrene is done under various conventional means such as humidity-controlled rooms, and warm air movement over the surface areas to evaporate the moisture.

The dried pieces of polystyrene are then reused in the following manner. A mold is made out of wood, metal, fiberglass, epoxy-concrete type plaster, or weldable polyethylenes, and the like to make a six sided box. The box lid is opened and the inside of the box is sprayed first with polyurea having the following formulation:

| Solution A | |
|---|---|
| Rubinate 9432 | 100% |
| **Solution B** | |
| Unilink 4200 | 3.0% |
| Jeffamine D2000 | 65.875% |
| Ethacure 100 | 23.125% |
| Jeffamine T5000 | 8.0% |

The components of Solution B were mixed together 1:1 by volume and the polymer solution (Solution A and Solution B) was applied using a plural component spray machine.

Next, the thickness of polyurea sprayed into the mold was between 1/16 inch to 1/8 inch thick. Then a layer of polyurethane foam (ELASTOPOR® F, BASF Aktiengesellschaft, Mount Olive, N.J.) in the 1–10 pounds per cubic foot density range is sprayed directly onto the polyurea-coated surfaces and allowed to start expansion inwardly. The dried recycled polystyrene pieces are dropped into the void. The box lid is closed and clamped to seal the rising foam inside the mold and in order for the recycled pieces to be "cemented" together by the slow-rising polyurethane foam. When the box is opened, the top portion is coated with polyurea to finish the floatation device.

It is to be understood that the Examples herein are illustrative embodiments and that this invention is not to be limited by any of the Examples or details in the Description. Those skilled in the art will recognize that the present invention is capable of many modifications and variations without departing from the scope of the invention. Accordingly, the Detailed Description and Examples are meant to be illustrative and are not meant to limit in any manner the scope of the invention as set forth in the following claims. Rather, the claims appended hereto are to be construed broadly within the scope and spirit of the invention.

We claim:

1. A floatation device for supporting a dock or boathouse on or extending over a body of water, wherein the floatation device comprises a foam material encapsulated by a coating of an elastomeric material, wherein the coating consists essentially of polyurea, epoxy or a polyurethane-polyurea hybrid.

2. The floatation device of claim 1, wherein the elastomeric material is polyurea.

3. The floatation device of claim 2, wherein the foam material comprises expanded polystyrene, polyurethane foam, or blown polyethylene foam.

4. The floatation device of claim 2, wherein the foam material comprises expanded polystyrene.

5. The floatation device of claim 1, wherein at least part of the foam material is recycled foam material.

6. The floatation device of claim 5, wherein the recycled foam material is recycled polystyrene.

7. The floatation device of claim 1, wherein the floatation device consists of the foam material and the elastomeric material.

8. The floatation device of claim 1, wherein the coating thickness is about 1 mil to about 250 mils.

9. The floatation device of claim 1, wherein the coating thickness is about 60 mils to about 75 mils.

10. The floatation device of claim 1, wherein the coating further comprises at least one of a colorant and UV protectants.

11. A method of manufacturing a floatation device for supporting a dock or boathouse on or extending over a body of water, wherein the floatation device comprises a foam material encapsulated by a coating of an elastomeric material, wherein the coating consists essentially of polyurea, epoxy or a polyurethane-polyurea hybrid.

12. The method of claim 11, wherein the elastomeric material is polyurea.

13. The method of claim 12, wherein the foam material comprises expanded polystyrene, polyurethane foam, or blown polyethylene foam.

14. The method of claim 13, wherein the foam material comprises expanded polystyrene.

15. The method of claim 13, wherein at least part of the foam material is recycled foam material.

16. The method of claim 15, wherein the recycled foam material is recycled polystyrene.

17. A coated foam block for supporting a dock or boathouse on or extending over a body of water, wherein the coated foam block comprises a foam material encapsulated with a coating of an elastomeric material, wherein at least a portion of the foam material comprises recycled foam material, and wherein the coating consists essentially of polyurea, epoxy or a polyurethane-polyurea hybrid.

18. The floatation device of claim 17, wherein the recycled foam material is recycled polystyrene.

19. The floatation device of claim 17, wherein the foam material further comprises expanded polystyrene, polyurethane foam, or blown polyethylene foam.

* * * * *